US008690482B2

(12) United States Patent
Fey

(10) Patent No.: US 8,690,482 B2
(45) Date of Patent: Apr. 8, 2014

(54) PILE ENCAPSULATION SYSTEM AND METHOD

(76) Inventor: Wayne Fey, Asheville, NC (US)

( * ) Notice: Subject to any disclaimer, the term of this patent is extended or adjusted under 35 U.S.C. 154(b) by 82 days.

(21) Appl. No.: 13/462,278

(22) Filed: May 2, 2012

(65) Prior Publication Data

US 2013/0294841 A1 Nov. 7, 2013

Related U.S. Application Data

(60) Provisional application No. 61/481,970, filed on May 3, 2011.

(51) Int. Cl.
*E02D 5/64* (2006.01)

(52) U.S. Cl.
USPC ..... 405/211; 405/216

(58) Field of Classification Search
USPC ..... 405/211, 216, 257; 249/1; 52/835
See application file for complete search history.

(56) References Cited

U.S. PATENT DOCUMENTS 1,324,422 A * 12/1919 Larsen ..... 249/1
3,553,970 A * 1/1971 Wiswell, Jr. ..... 405/216
3,708,146 A * 1/1973 Lamberton ..... 249/1
3,719,049 A * 3/1973 Shaw et al. ..... 405/216
3,736,759 A * 6/1973 Blose ..... 405/216
4,116,013 A * 9/1978 Hellmers ..... 405/216
4,439,070 A * 3/1984 Dimmick ..... 405/216
4,487,643 A * 12/1984 Ellett ..... 156/80
4,585,681 A * 4/1986 Kidera et al. ..... 405/231
4,983,072 A * 1/1991 Bell, Jr. ..... 405/216
4,993,876 A * 2/1991 Snow et al. ..... 405/216
5,226,751 A * 7/1993 Doleshal ..... 405/211.1
5,591,265 A * 1/1997 Tusch ..... 118/404
5,829,920 A * 11/1998 Christenson ..... 405/216
5,919,004 A * 7/1999 Christenson ..... 405/216
6,167,672 B1 * 1/2001 Okitomo ..... 52/834
6,536,991 B1 * 3/2003 Trader et al. ..... 405/216
7,300,229 B1 * 11/2007 Fyfe et al. ..... 405/216
2002/0094239 A1 * 7/2002 Bradley et al. ..... 405/216

* cited by examiner

*Primary Examiner* — Benjamin Fiorello
(74) *Attorney, Agent, or Firm* — Daniel Law Offices, P.A.; Jason T. Daniel, Esq.

(57) ABSTRACT

A pile encapsulation system include a lower collar that is removably secured to the concrete pile at a position beneath the damaged section, an upper collar that is removably secured to the concrete pile at a position above the damaged section, and one or more form units interposed between the upper and lower collars, each of the form units including a hollow interior space for surround the damaged section of the concrete pile and forming a mold for fresh concrete.

14 Claims, 10 Drawing Sheets

PILE ENCAPSULATION SYSTEM AND METHOD

CROSS-REFERENCE TO RELATED APPLICATIONS

This application claims the benefit of U.S. application Ser. No. 51/481970 filed on 3 May, 2011, the contents of which are incorporated herein by reference.

TECHNICAL FIELD

The present invention relates generally to concrete piling rehabilitation, and more particularly to an encapsulation system and method for repairing damage to surface and subsurface concrete pilings without the need for underwater divers.

BACKGROUND

The statements in this section merely provide background information related to the present disclosure and may not constitute prior art.

Concrete pilings are traditionally utilized in industrial, bridge and marine construction projects due to their strength, corrosion resistance and ability to withstand long term exposure to adverse elements. However, over time these pilings can deteriorate due to factors such as marine life and extreme weather conditions, or can become damaged from collisions with boats and other such vehicles. When a concrete pile is damaged or deteriorated, it may be necessary to reinforce the outer surface of the pile with new concrete.

Traditionally, this process has involved the use of various pieces of custom built equipment and, in marine environments, the need for underwater divers to access the damaged area and to effectuate a repair.

Accordingly, the need exists for a pile encapsulation system and method capable of allowing a user to repair a damaged concrete pile without the drawbacks described above.

SUMMARY OF THE INVENTION

This summary is provided merely to introduce certain concepts and not to identify key or essential features of the claimed subject matter.

The present invention is directed to a pile encapsulation system and method for repairing a damaged concrete pile. One embodiment of the present invention can include a lower collar that can be removably secured to the concrete pile at a position beneath the damaged section, an upper collar that can be removably secured to the concrete pile at a position above the damaged section, and one or more form units interposed between the upper and lower collars, each of the form units including a hollow interior space that can surround the damaged section of the concrete pile.

Another embodiment can include a pump inlet port secured within the form unit in order to receive concrete and deposit the same into a space between the form unit and the damaged section of the concrete pile.

Yet another embodiment can include a method for repairing a damaged concrete pile utilizing the pile encapsulation system.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

The present application can be utilized with co pending U.S. patent application Ser. No. 13/421,097 to Fey, entitled rebar attachment device and system, the contents of which are incorporated herein by reference.

Although described below as being utilized with a concrete pile/piling in a marine environment, one of skill in the art will recognize that the inventive concepts disclosed herein can be utilized in many different applications and with many different types of structures such as concrete columns and/or wood or metal, for example. For purposes of this description, the terms "upper," "bottom," "right," "left," "front," "vertical," "horizontal," and derivatives thereof shall relate to the invention as oriented in FIG. 1*a*

Figure 6:
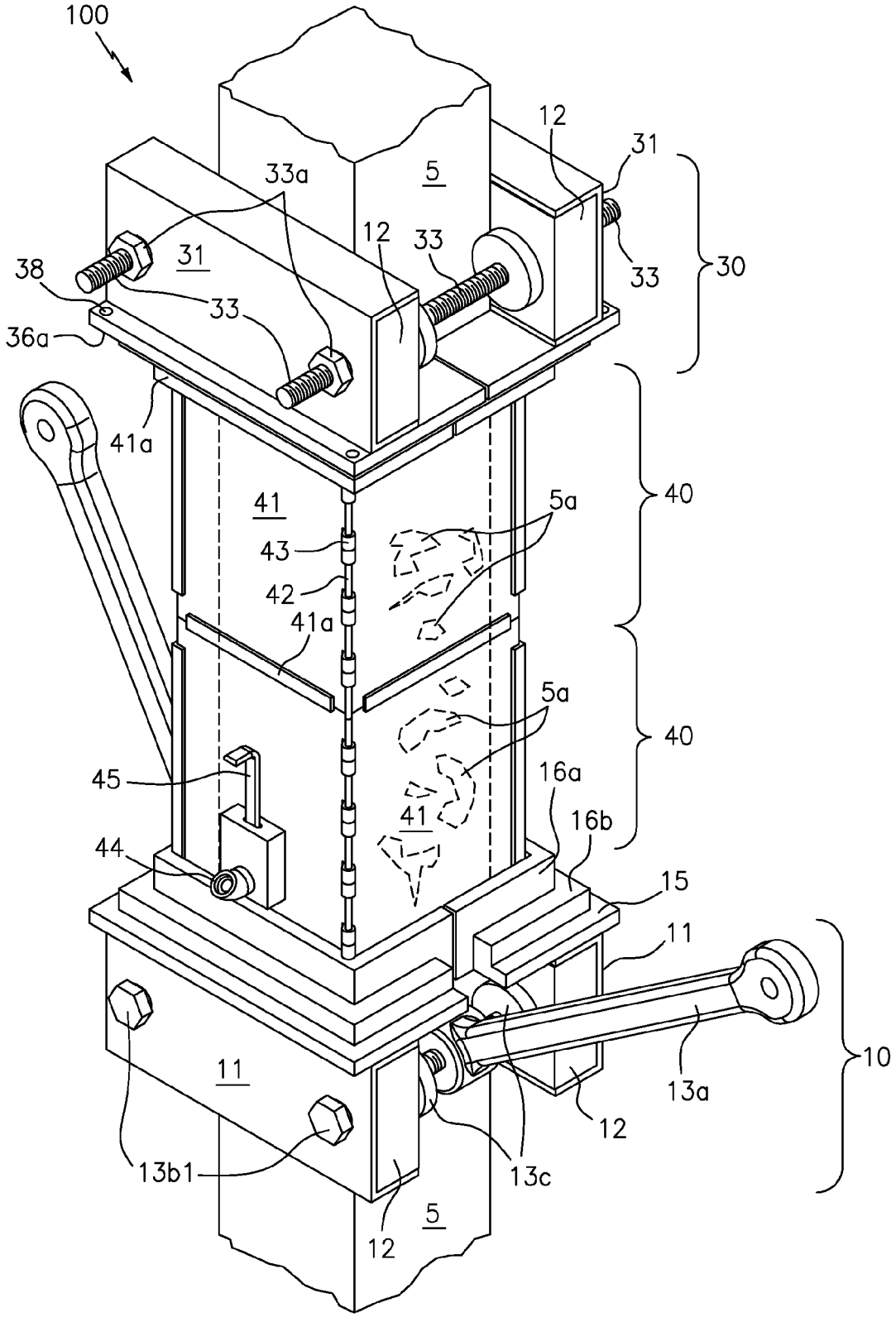
FIG. 6 illustrates a perspective view of one embodiment of the pile encapsulation system.

A pile encapsulation system 100, according to one embodiment can include a lower friction collar 10, an upper friction collar 30 and a form assembly unit 40 (see FIG. 6).

Figure 1A:
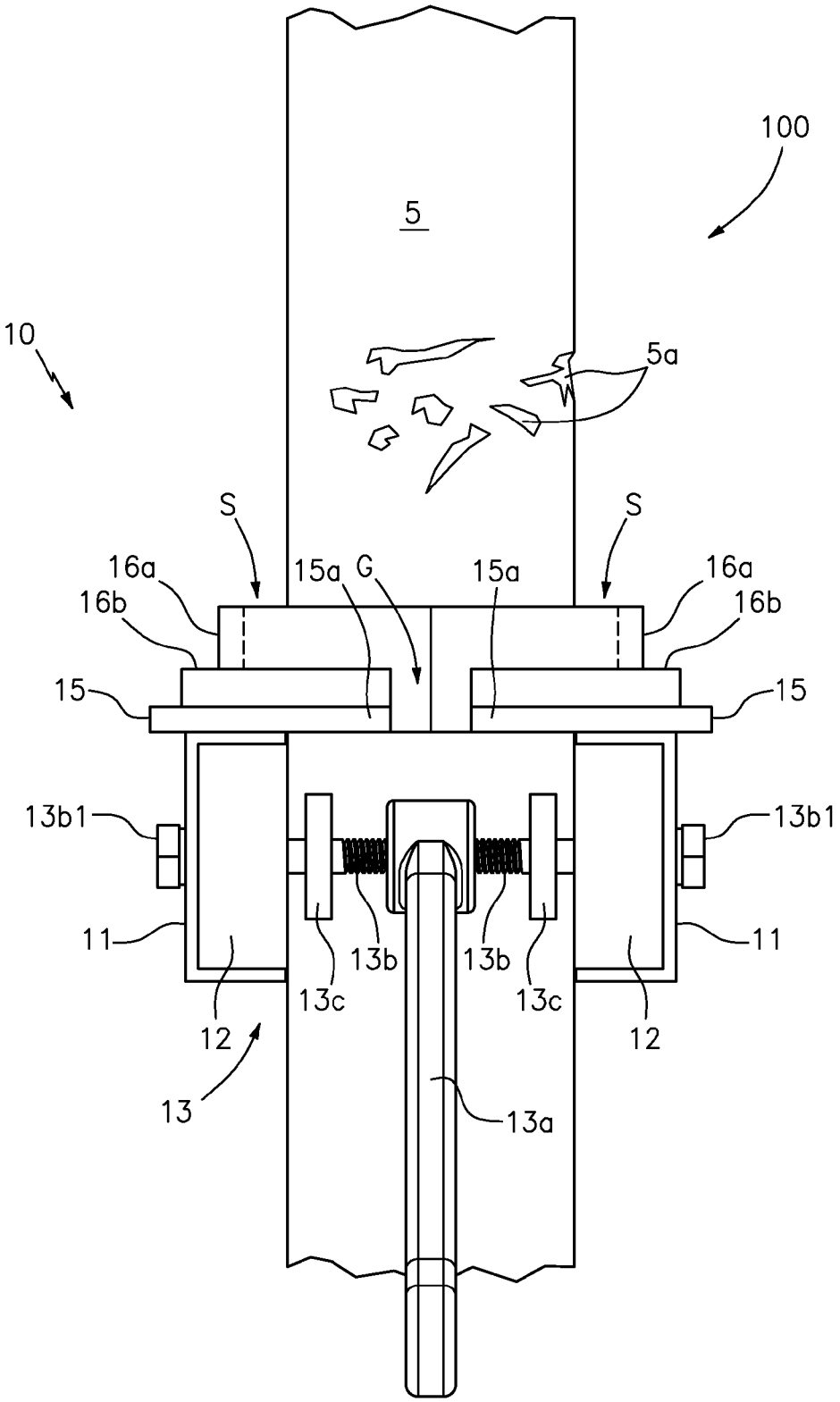
FIG. 1*a* illustrates a front view of one embodiment of a lower friction collar for use with the pile encapsulation system.
Figure 1B:
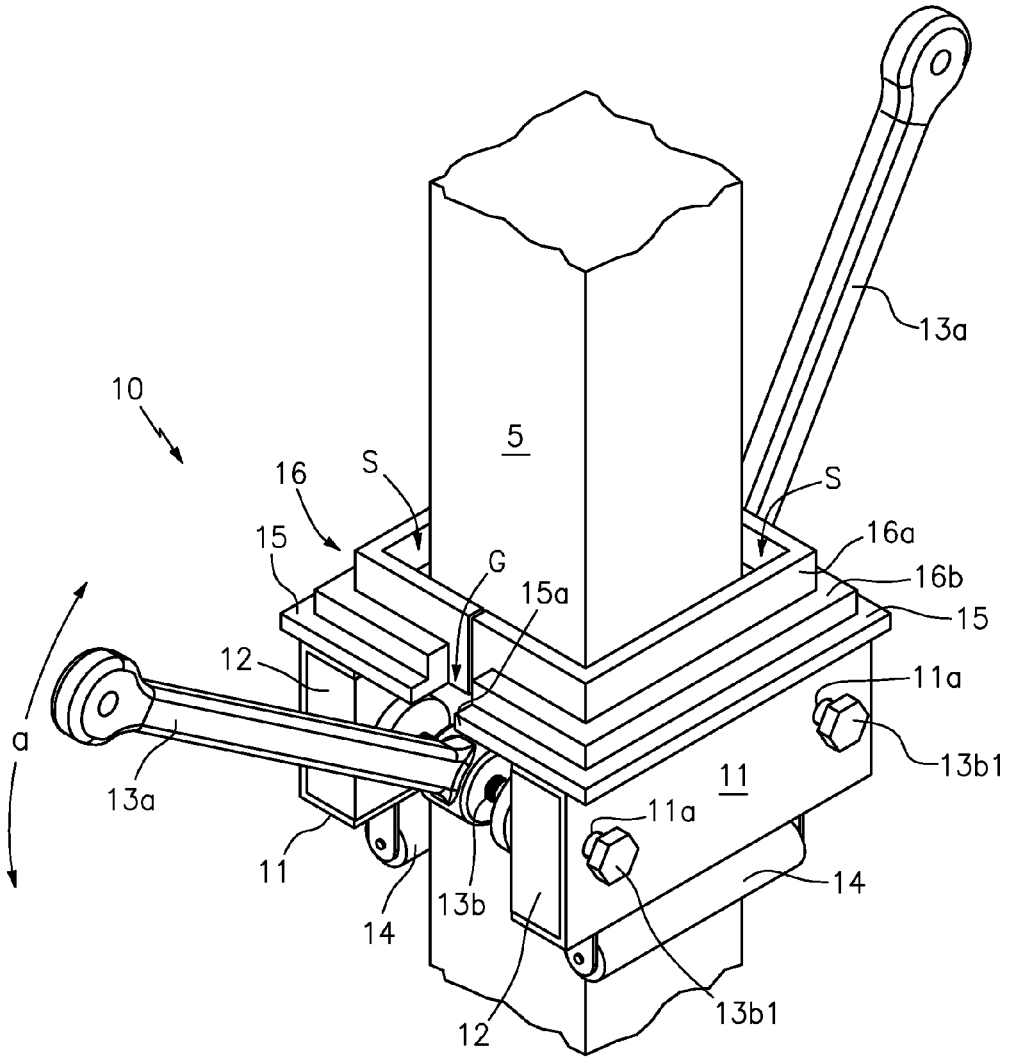
FIG. 1*b* illustrates a perspective view of one embodiment of a lower friction collar for use with the pile encapsulation system.

FIGS. 1*a* and 1*b* illustrate one embodiment of a lower friction collar 10 that is useful for understanding the inventive concepts disclosed herein. The lower friction collar 10 can include essentially two complementary halves configured to be secured together to form a single platform about the exterior surface of a concrete pile. When so connected, the collar 10 can support the weight of the system 100 in order to form a mold for pouring new concrete in order to repair a damaged or deteriorated section 5*a* of the piling.

As shown, the lower friction collar 10 can include a complementing pair of elongated generally C-shaped channels 11, a pair of binding units 13, base plates 15 and form receivers 16, each configured to surround one half of the cross section of the concrete pile.

The opposing C-channels 11 can form the lowermost portion of the collar 10 and can act to position opposing pieces of lumber 12 or other similar materials having a high coefficient of friction against the face of a pile 5. Each end of both of the C-channels 11 can include openings 11*a* through which ratchet pins or other such hardware for securing the channels to the pile can be positioned. In one preferred embodiment, each of the C-channels 11 can be constructed from an elongated aluminum channel having a dimension of approximately 6"×¼". Of course, other dimensions and materials are also contemplated.

Bindings 13 are positioned on both ends of the C-channels, in order to secure each half of the friction collar together and to the pile itself. As described herein, bindings 13 can preferably include a ratchet binder 13*a* having a pair of counter rotating pins 13*b* extending through the lumber 12 and the opening 11*a* of the C-channels. As shown, the outside end of each pin can include a head 13*b*1 that is larger than the opening 11*a*, and the inside end of each pin can be configured to mate with the ratchet binder 13*a* in a conventional manner. Accordingly, each of the bindings 13 can act to tighten the opposing C-channels 11 to the pile 5 until a desired friction point has been reached.

In operation, the inclusion of the ratchet binder 13*a* having an elongated handle, can act to allow surface personnel to tighten the pins 13*b* without having to enter the water. This can be done through direct contact with the handle or by utilizing a handle extension, such as an elongated pipe, for example.

Additionally, one or more generally circular ratchet guide rollers 13*c* can be positioned about each pin 13*b* at a location between the guide ratchet 13*a* and the lumber 12. The guide roller 13*c* can act as a cushion for reducing or eliminating damage to the concrete pile which may have otherwise occurred from contact with the pin 13*b*. By including a circular shape, the guide rollers 13*c* can roll along the surface of the pile when the collar 10 is being lifted or lowered, as will be described below.

Although described above as utilizing ratchet pins, ratchet binders and other specific hardware, one of skill in the art will recognize that virtually any type of known hardware suitable for securely positioning the C-channels to the pile in a removable fashion can be utilized. For example, in one alternate embodiment (See FIG. 2), each of the bindings 13 can comprise a single coarse threaded coil rod 21 passing through each side of the C-channel via openings 11*a* and tightened with threaded nuts 21*a* via a conventional ratchet, for example.

As shown best in FIG. 1*b*, each C-channel can further include an optional full width roller 14 secured to the bottom end, and configured to allow the lower friction collar 10 to roll vertically along the pile 5. In one preferred embodiment, each roller 14 can include a full width poly roller having excellent tensile strength and waterproof qualities, in order to prevent the C-channel itself from causing damage to the pile. Of course, other similar materials are also contemplated. The rollers 14 can act independently, or in unison with the guide rollers 13*c* to prevent damage to the pile.

A generally planar "U" shaped base plate 15 is secured to the top of each C-channel 11; the base plate 15 being positioned orthogonally with respect to the C-channels. Each base plate 15 can include an inside cross section configured to surround one half of the outside cross sectional dimension of the pile to be repaired. To this end, when positioned on the pile 5, the pair of base plates 15 form a flat, horizontal platform that can completely surround the pile 5. In one preferred embodiment, each of the base plates 15 can be constructed from a sturdy material such as steel or aluminum plating having a width of approximately six inches, that is permanently affixed, via a weld, for example to the channel. Of course, other materials, dimensions and construction methodologies are also contemplated.

In another embodiment, the outermost portion along the ends of each of the base plates 15*a* can be shortened to leave a gap G between opposing base plates when installed onto a pile. Such a feature can act to provide room for the upward motion of the ratchet binder 13*a* (See arrow A), to be operated by surface personnel, as will be described below.

Next, a pair of generally L-shaped form receivers 16 are positioned on top of the horizontal base plates 15. The form receivers act in unison to create a guide for receiving the form unit 40 described below. As shown, each form receiver 16 can be constructed from a sheet of aluminum or steel, and can include a vertical section 16*a* and a horizontal section 16*b*. In one preferred embodiment, the vertical and horizontal sections can have a relative angle to each other of approximately 90° and can be permanently secured onto the top of the base plate 15 so as to leave a precise space S for receiving the lower portion of the form unit 40.

Figure 2:
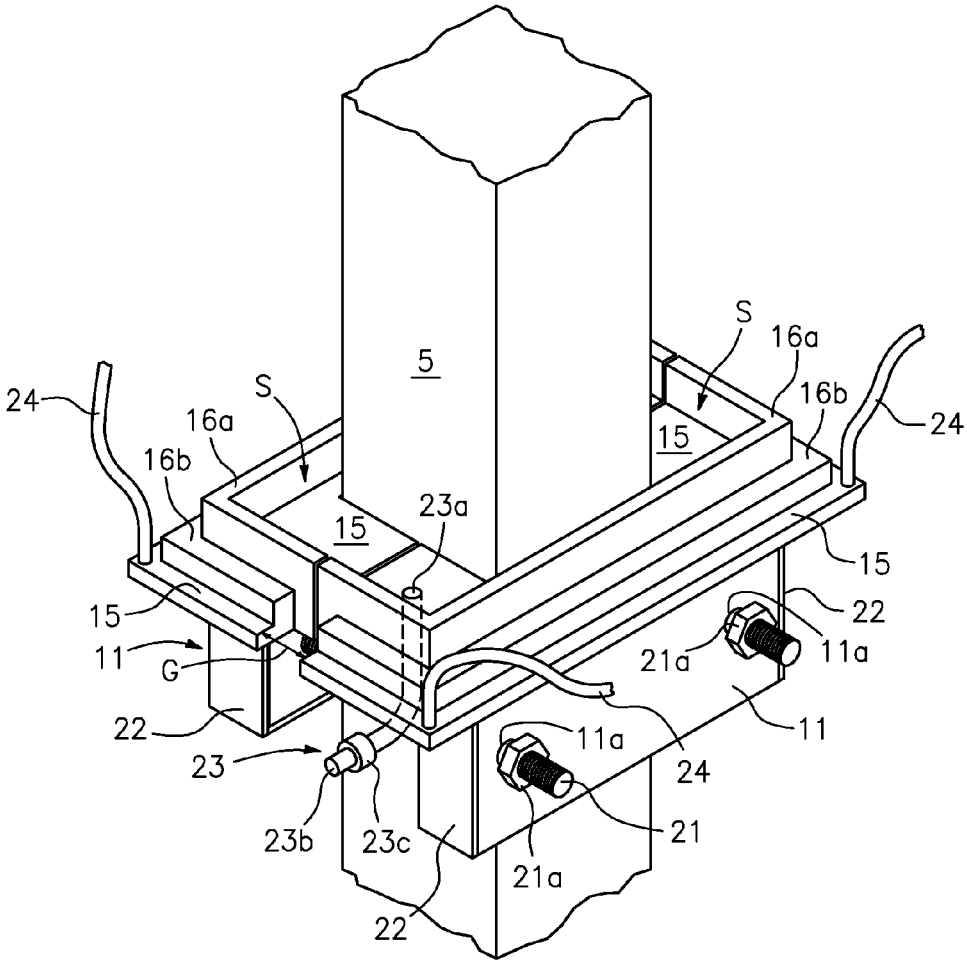
FIG. 2 illustrates a perspective view of one alternate embodiment of a lower friction collar for use with the pile encapsulation system.

FIG. 2 illustrates an alternate embodiment of the lower collar 10 that further includes support plates 22, a drain valve 23 and a plurality of recovery cables 24.

As shown, support plates 22 can be secured to the ends of each C-channel 11 in order to provide strength and rigidity to the device to prevent deformation of the channel caused by excessive torque. In one preferred embodiment, each of the support plates 22 can include steel or aluminum gussets that are welded onto the ends of each C-channel. Of course other traditional means of bracing can also be utilized.

The drain valve 23 can act to remove water from the system 100 prior to pouring fresh concrete. To this end, the drain valve 23 can include an elongated hollow pipe having a first end 23*a* that is conventionally secured through at least one of the base plates 15 within the space S provided between the pile 5 and the vertical section of the form receiver 16*a*. The other end of the valve 23*b* can be positioned below the base plate 15. The valve including a nozzle/flow regulator 23*c* capable of allowing a user to selectively open and close the pathway in order to remove water from the system. In one preferred embodiment, the drain valve 23 can be constructed from PVC and can have a dimension of approximately 1.5 inches. Of course any number of other materials and dimensions are also contemplated.

A plurality of recovery cables 24 can be conventionally secured to the lower friction collar 10 to enable easy positioning and movement of the collar by surface personnel. Additionally, the recovery cables can be utilized to align the various system components described below, in order to ensure proper fit and placement on the pile.

Figure 3:
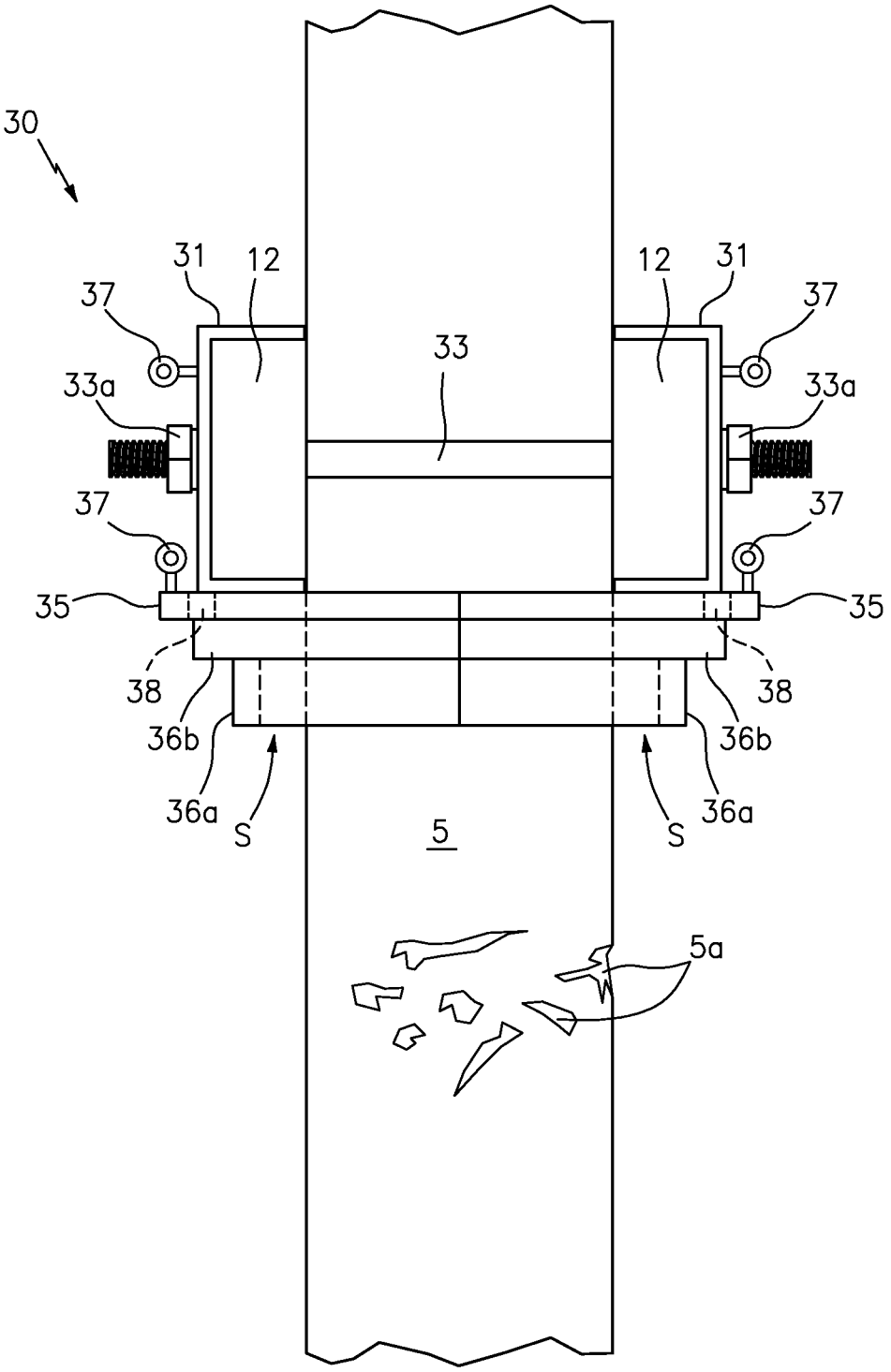
FIG. 3 illustrates a perspective view of one embodiment of an upper friction collar for use with the pile encapsulation system.

FIG. 3 illustrates one embodiment of an upper friction collar 30 which can be positioned at the top of the encapsulation system 100 and act to secure the top of the form assembly unit 40 to the pile 5. As shown, the upper friction collar 30 can include a pair of C-channels channels 31, bindings 33, a pair of opposing base plates 35 a pair of opposing form receivers 36, and a plurality of rigging eyes 37.

As described herein, each of the C-channels channels 31, bindings 33, opposing base plates 35 and form receivers 36, and all subcomponents can be constructed as essentially identical to the channels 11, bindings 13, base plates 15 and form receivers 16, respectively, described above with respect to the lower friction collar 10. As illustrated in FIG. 3, the upper friction collar 30 can be positioned along the top of the pile 5 in a manner that is upside down when compared to the lower friction collar 10. To this end, the upper C-channels 31 will be positioned above the upper base plates 35 which will act to position the upper form receivers 36*a* and 36*b* along the bottom of the collar 30. Additionally, a plurality of rigging eyes 37 can be secured to various components of the upper friction collar in order to facilitate deployment of the system. Rigging eyes are well known in the art and are used as anchor points onto which tethers and the like can be secured in order to facilitate handling of the collar.

As shown, a series of vertical openings 38 can be positioned along the periphery of the upper base plate 35. Each of these openings can include a diameter sufficient to allow a connection rod 42 (described below), and/or a recovery cable 24 to pass through. Such a feature can allow for easy deployment of the form unit 40 by surface personnel.

Figure 4A:
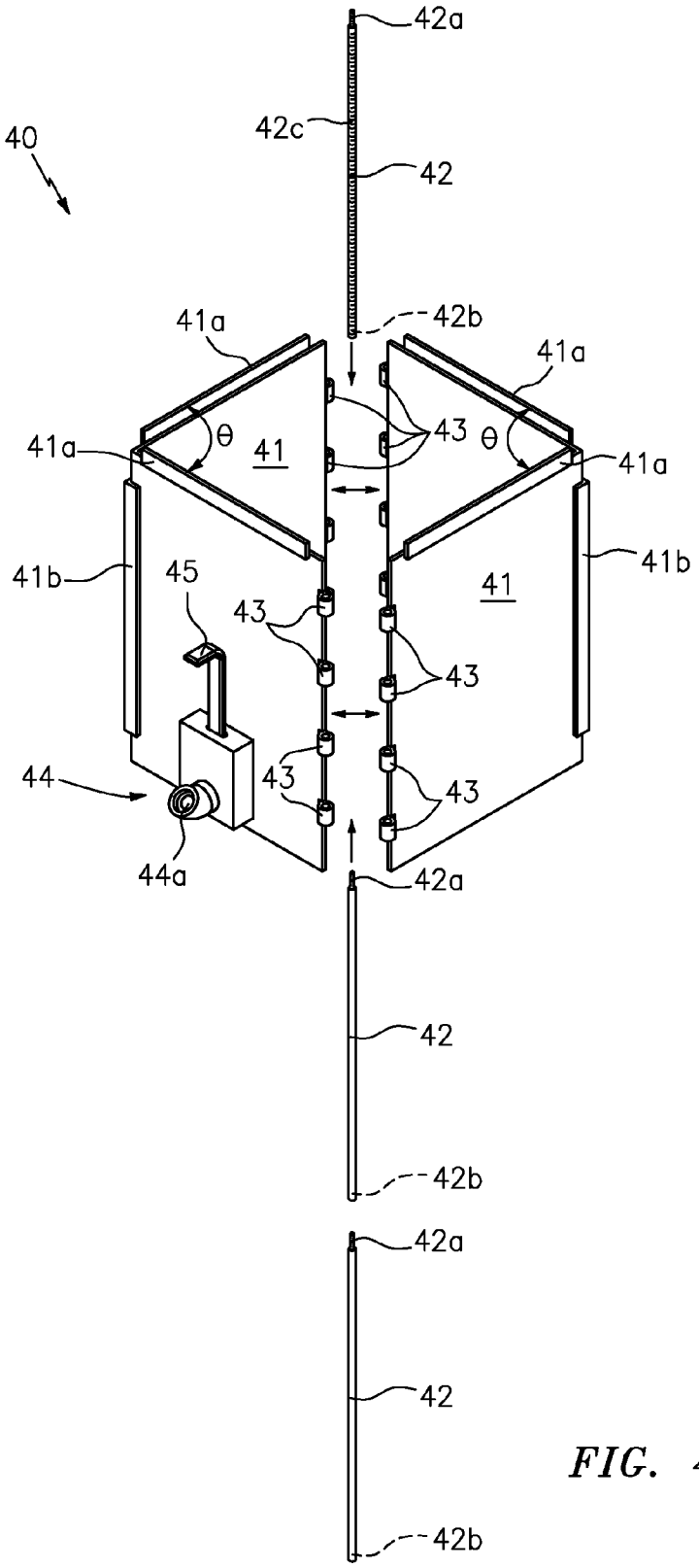
FIG. 4*a* illustrates an exploded parts view of a form unit for use with the pile encapsulation system in accordance with one embodiment.
Figure 4B:
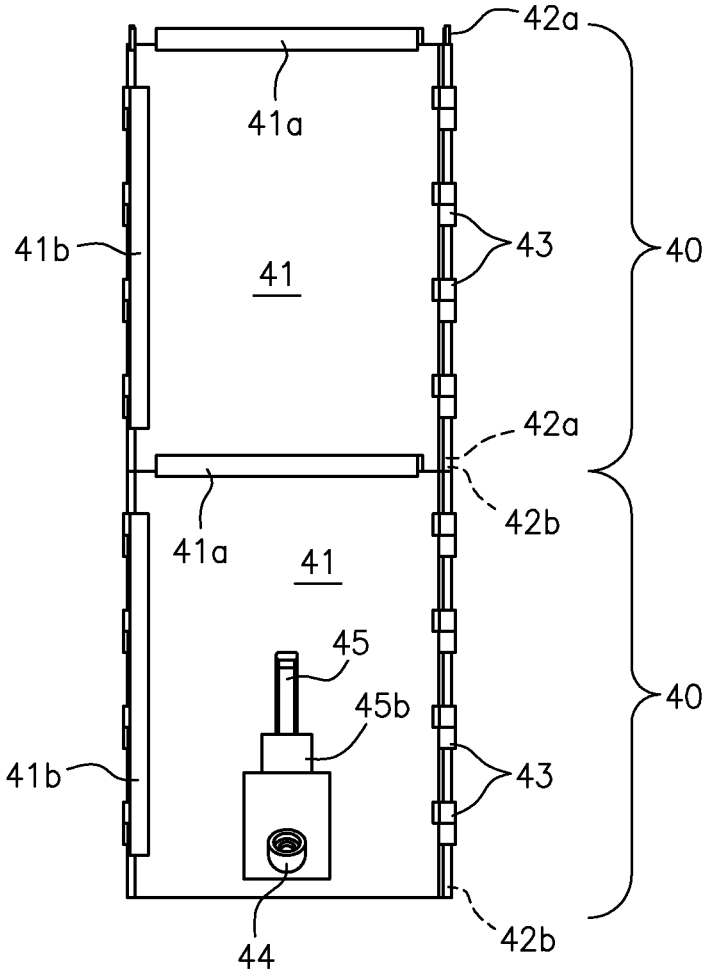
FIG. 4*b* illustrates a front view a plurality of form units for use with the pile encapsulation system in accordance with another embodiment.

FIGS. 4*a* and 4*b* illustrate one embodiment of a form unit 40. As will be described below, one or more assembled form units 40 can be interposed between the top friction collar 30 and the bottom friction collar 20 in order to completely surround a damaged portion of a concrete pile. When so positioned, the form unit(s) 40 can act as a box and/or a mold for receiving fresh concrete and securely positioning the same onto the damaged section. To this end, each form unit 40 can include a pair of angled form plates 41, each having a series of complementing receptacles 43 that are configured to align together to receive one or more connection rods 42.

Each of the angled form plates 41 can preferably be constructed from a single elongated sheet of ¼" thick rectangular rolled steel or aluminum plating having an approximately 90° bend θ in the center. Optional support braces 41*b* can be welded to the outside portions of the bends in order to provide additional structural support. As shown, each of the form plates 41 can further include a sleeve 41*a* that is positioned along the outside upper periphery in order to act as a collar for allowing multiple form plates 41 to be securely stacked together in a vertical manner (See FIG. 4*b*). As described herein, the sleeve 41*a* allow a pair of form plates to be stacked top to bottom by providing a lip/protrusion that will prevent movement of the plates when so positioned. To this end, multiple assembled form units 40 can be vertically stacked and positioned between the upper and lower friction collars.

Although described above as including steel and/or aluminum components, and specific dimensions, other dimensions and composite materials such as fiberglass, for example, having a resilient structural integrity can also be utilized to create the form plates 41 and the assembled form unit(s) 40.

Returning to FIG. 4*a*, each end of the opposing angled form plates 41 includes a plurality of pipe receptacles 43 configured to align top to bottom with the pipe receptacles 43 of the opposing form plate, in order to create a pathway through which one or more connection rods 42 can be positioned. In one preferred embodiment, each connection rod 42 can be constructed from an elongated steel rod/pin having a protruding threaded edge 42*a* on a first end, and a recessed threaded edge 42*b* on a second end. To this end, the protruding edge 42*a* of a first rod can be removably secured to the recessed end 42*b* of another rod via a twisting/tightening motion. As such, a plurality of rods each having the same or different lengths can be secured together in order to accommodate any number of form units.

In operation, upon aligning the receptacles 43 of each angled plate together to form a pathway, one or more rods 42 can be inserted through each of the receptacles 43 of each plate 41 thus creating an assembled form unit having an inside surface area capable of surrounding a concrete pile. When so constructed, each of the rods can be further held in place by a pair of stripping nuts (not illustrated) or other conventional hardware capable of preventing the form plates 41 from separating. To this end, the assembled form unit can include, essentially, a hollow box having an open top and an open bottom.

In one alternate embodiment, one or more of the rods 42 can include a threaded outside surface 42*c* capable of allowing the rods to be screwed into complementary threads (not illustrated) on the receptacles, thus forming a tight bond between the rods and receptacles at every point of contact, and greatly decreasing the likelihood of an unintended separation. In either instance, the rods and receptacles can act in a similar fashion to a conventional door hinge and bolt. These components being well and truly known in the art, no further description will be provided.

In one embodiment, one or more of the form units 40 can further include a concrete pump inlet port 44 that is preferably positioned along the bottom end of one or more of the angled plates 41. As shown, the pump inlet can include a generally hollow tubular member configured to mate with a conventional concrete supply line via embedded threads, 44*a* and/or conventional compression fittings, quick connect adaptors or other conventional hardware. The inlet port 44 can thus provide a pathway for allowing concrete (or other desired substances) to pass through the angled plate 41 and into the center of the assembled form unit 40 in order to make contact with the damaged section of the pile 5*a*. As will be described below, the pump inlet port 44 can allow fresh concrete to be poured underneath the waterline of a pile 5 by surface personnel without requiring divers to enter the water.

A valve 45 having a controller 45*a* can be positioned adjacent to the inlet port 44 in order to control the flow of material (e.g., concrete) into the form interior. In the illustrated embodiment, valve 45 comprises a flat plate 45*b* connected to the end of a control rod 45*a* and is configured to manually block a flow of material into the form by sliding downward into the inlet port 44. However, one of skill in the art will recognize that many other types of valves such as waterproof electrical valves/actuators, for example can be utilized without deviating from the scope and spirit of the inventive concepts disclosed herein.

Figure 5A:
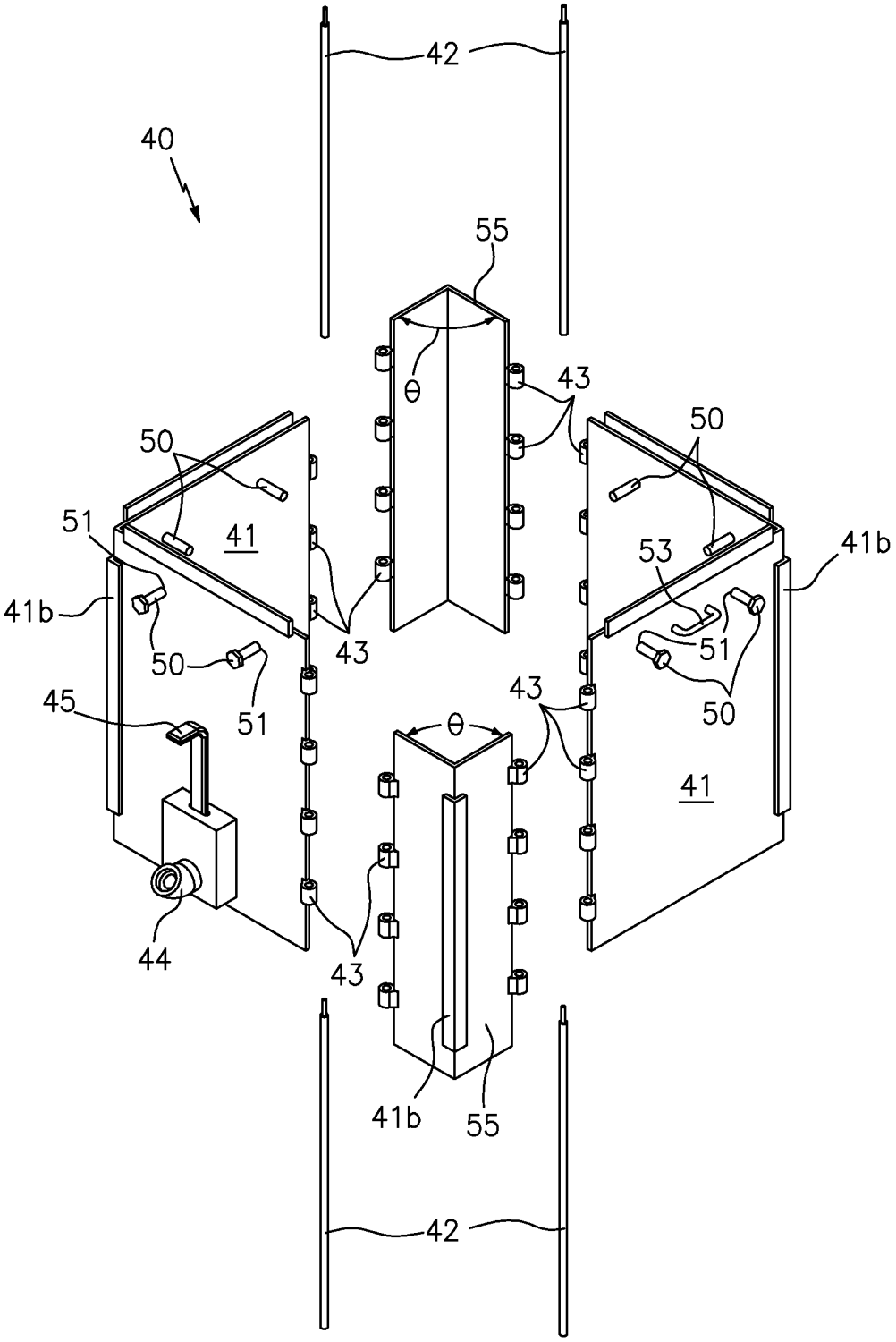
FIG. 5*a* illustrates an exploded parts view of an alternate embodiment of a form unit for use with the pile encapsulation system.
Figure 5B:
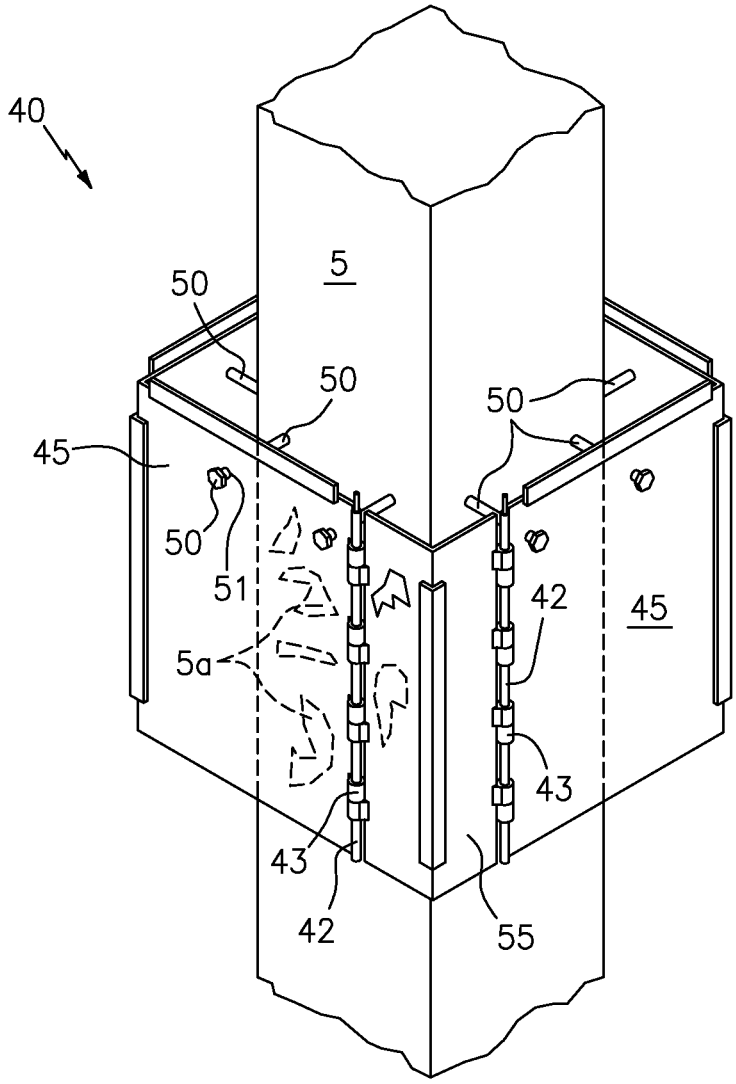
FIG. 5*b* illustrates a front view of the alternate embodiment of a form unit for use with the pile encapsulation system.

FIGS. 5*a* and 5*b* illustrate an alternate embodiment of a form unit 40 that further includes a plurality of standoff bolts 50, handles 53 and form extenders 55.

The standoff bolts 50 can act as a tool for ensuring proper separation between the angled plates 41 and the concrete pile 5. As shown, each of the angled plates 41 can include a plurality of threaded openings 51 configured to receive and securely position the bolts 50, which are preferably constructed from steel. To this end, each of the bolts 50 and the openings 51 can include complementing threads capable of allowing a user to removably and adjustably insert the bolts through the angled plate 41 until making contact with the concrete piling 5. Such a feature can act to ensure that each section of the assembled form 40 is positioned about the pile at a desired distance. This distance can be the same for all sides of the pile, or can be a different distance depending on the amount each bolt protrudes into the center of the form.

One or more handles 53 can be secured to each of the angled plates 41 in order to facilitate handling by the user. The handles will preferably be constructed from steel or aluminum and will be welded to the forms.

The form extenders 55 can act as a tool for expanding the overall dimension/cross section of the assembled form unit 40. Each of the form extenders 55 can preferably be constructed from a single sheet of ¼" thick rectangular steel or aluminum having a 90° bend θ positioned in the center, and a plurality of receptacles 43 positioned on either side. Each of the receptacles 43 of the form receiver 55 being configured to mate with the complementing receivers 43 on the angled plates 41 in order to make a pathway for receiving a rod 42, as described above. To this end, each of the form extenders 55 can be interposed between the ends of the two angled plates 41 in order to expand the interior cross section of the assembled form unit 40, and therefore increase the size of the concrete piling which the form can accommodate.

As described above, the angled plates 41 and the form receiver 55 can include any number of sizes, lengths and widths to suit the most common concrete pilings, or may be custom fabricated to include dimensions suitable for adapting to non-standard concrete pilings. Moreover, although illustrated above as including square components having angled bends approximating 90°, other embodiments are also contemplated wherein each of the collars and form units include different shapes such as circles, for example. Accordingly, the invention is not limited to solely square/rectangular shapes.

FIG. 6 illustrates one embodiment of the encapsulation system 100 in operation that includes the bottom collar 10, the top collar 30 and a pair of form units 40 described above installed onto a damaged pile 5. As shown, the lower collar 10 can be positioned beneath the damaged section 5*a* and can act as a platform for positioning the form units 40 at a precise location in order to surround the damaged section. In this illustration, two form units are shown; however, any number of individual form units 40 can be utilized for each application, depending on the size of the damage to the piling. Upon positioning the form units into the space S provided by the lower collar 10, the upper collar 30 can be lowered onto the top of the upper form unit and secured to the pile in order to prevent separation.

As described herein, the form unit(s) 40 can be mated to the bottom and top collars 10 and 30, respectively, by positioning the lower and upper surfaces of the assembled form unit 40 into the spaces S provided by the vertical sections 16*a* and 36*a* of the collar form receivers, respectively. Upon securing the system 100 to the damaged pile, any water that is located within the form unit can be removed via the valve 23, and an external concrete pump can be coupled to the pump port 44 via a hose or other conventional device. When so connected, the system can receive fresh concrete that can fill the void between the form plates 41 and the concrete pile 5. Upon filling the interior space of the assembled form units with concrete, the system can remain in place until the concrete hardens, after which time the entire system can be retrieved for subsequent use.

As described herein, one or more elements of the encapsulation system and corresponding devices can be constructed from known materials ranging from rolled steel, aluminum, fiberglass and other composite materials. Each of these components can be secured together utilizing any number of known attachment means such as, for example, welds, screws, glue, and other compression fittings.

Figure 7:
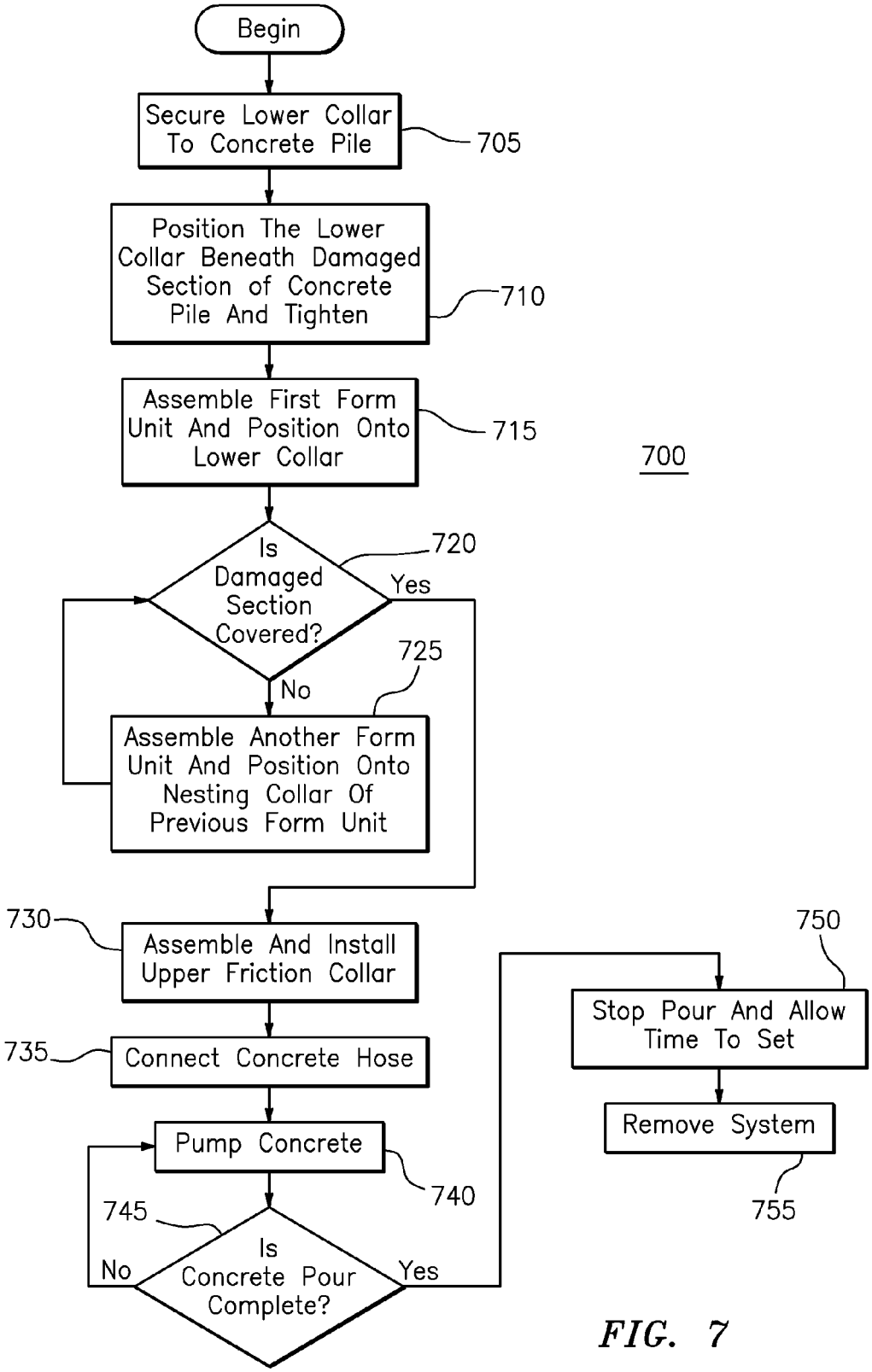
FIG. 7 illustrates one embodiment of a method of repairing damaged concrete pilings utilizing the pile encapsulation system.

FIG. 7 is a flow chart illustrating a method 700 for repairing a concrete pile utilizing the encapsulation system 100 described above.

The method can begin at step 705 in which the lower friction collar 10 is secured to the pile 5 by aligning each half of the collar around the top of the pile, at a location above the water line and securing the halves together by threading the opposing pins 13*b* through the outside of the C-channel 11, through the lumber 12 and onto the ratchet binder 13*a*. When so positioned, the ratchet binder 13*a* can act to partially tighten the collar halves in order to prevent separation.

When so positioned, the method can proceed to step 710, where the lower friction collar 10 can be lowered to the required elevation of the pile (i.e. below a damaged portion 5*a*) via the rollers 14 and the recovery cables 24. Upon reaching the desired elevation the ratchet binders of the lower collar assembly can be tightened to a desired tension that is sufficient to ensure the lower collar will not move. In instances where the lower collar 10 and/or the ratchet binders are underwater, a pipe or ratchet extension handle can be used to manipulate the ratchet binder 13*a* in order to allow surface personnel to operate the ratchet binder handle without having to enter the water. To this end, the gap G of the base plate allows a full 180 degree rotation (See arrow A) without making contact with the collar itself, thus allowing surface personnel working above the position of the collar to be able to easily operate the ratchet unit 13.

Next, the method can proceed to step 715 where a form unit 40 can be assembled and lowered down the pile 5 until resting on the lower friction collar 10. To this end, the bottom edge of the form unit 40 can rest within the space S formed by the vertical section 16*a* of the lower friction collar 10. In step 720, if the first form unit does not completely cover the damaged section of piling, then the method will proceed to step 725, alternatively, if the first form unit 40 does cover the entirety of the damaged section, the method will proceed to step 730.

In step 725, a second form unit 40 can be assembled and lowered down the pile 5 until resting on the nesting sleeve 41*a* of the lower form unit. This step is repeated until the damaged section is covered by the form unit(s) 40 and then the method proceeds to step 730.

In step 730, the upper friction collar 30 can be assembled and secured onto the pile 5. The upper collar can then be lowered until resting on top of the upper surface of the uppermost form unit 40. When so positioned, the upper collar 30 can be tightened in place by surface personnel via the upper bindings 33.

Upon determining that the system is securely positioned to the pile 5 so that the one or more form units 40 are covering the damaged section 5*a*, repairs to the damaged pile can begin. Repairs begin in step 735 by connecting a conventional concrete hose to the pumping port 44; however, this step can also be performed prior to securing the form unit(s) 40 to the pile. Upon confirming the hose connection, the port 44 can be opened via the valve 45 and concrete can begin to flow into the bottom of the form in step 740.

As concrete has a higher specific gravity than water, the concrete will act to push any water inside the form upward and out of the form 40, until the concrete mixture has completely filled the space S behind the form unit 41 and the damaged pile 5*a*. To this end, the concrete will act to fill the damaged portions of the pile 5*a* and will create a "ring" around the area in the shape of the form plates 41. In step 745, a determination will be made that an appropriate amount of concrete has been poured, and the concrete pouring will cease at step 750, at which point the concrete will be allowed to set for an appropriate period of time during which the encapsulation system will remain in place.

Once the concrete has set, each of the upper and lower friction collars, along with the form unit can then be removed by surface personnel in step 755. In one embodiment, the ratchet binders of the lower unit can be loosened by surface personnel until the collar separates into two halves which can be retrieved by the recovery cables 24. With regard to the upper collar and the form unit, these can be removed whole or in halves, in much the same way described above.

Accordingly, the pile encapsulation system and method described herein can allow a user to easily and safely repair surface and marine concrete pilings, at locations both above and below the water surface without the need for underwater divers. As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A pile encapsulation system for repairing a concrete pile having a damaged section, said system comprising:

a lower collar configured to be removably secured to the concrete pile at a position beneath the damaged section, said lower collar including an upper surface having a first form receiver secured thereon, a pair of elongated channels configured to position opposing pieces of lumber against the concrete pile, each of said channels having a first end and a second end, a pair of base plates interposed orthogonally between a top surface of the channels, and a bottom surface of the first form receiver, said base plates being configured to form a horizontal platform around the pile, and a pair of bindings configured to removably secure the first ends of each of the channels together and the second ends of each of the channels together, respectively about the pile;

an upper collar configured to be removably secured to the concrete pile at a position above the damaged section, said upper collar including a bottom surface having a second form receiver secured thereon;

one or more form units having a top end configured to mate with the second form receiver, and a bottom end configured to mate with the first form receiver, each of said form units including a hollow interior space configured to surround the damaged section of the concrete pile; and a pump inlet port secured within the form unit, said port being configured to receive concrete and deposit the same into a space between the form unit and the damaged section of the concrete pile.

2. The system of claim 1, further comprising:

a valve controller secured to the inlet port, said valve controller being configured to regulate a volume of concrete received by the system.

3. The system of claim 1, further comprising:

a plurality of support plates secured to each end of each of the elongated channels, said support plates being configured to prevent a deformation of the channels;

a drain valve secured through at least one of the base plates at a location between the pile and the form receiver, said drain valve being configured to remove water from the system; and a plurality of recovery cables secured to one of more of the base plates and the channels.

4. The system of claim 1, wherein each of the bindings comprise:

a pair of counter rotating pins that are in communication with each of the pair of elongated channels;

a pair of circular ratchet guide rollers positioned about each of the counter rotating pins, said ratchet guide rollers being configured to roll along the concrete pile; and a ratchet binder that is in communication with each of the counter rotating pins, said ratchet binder being configured to apply a mechanical force to the pins to tighten the elongated channels to the pile.

5. The system of claim 4, further comprising a gap located on the pair of base plates at a location adjacent to the ratchet binder, said gap being configured to allow a 180 degree movement of a ratchet handle.

6. The system of claim 1, wherein the upper collar comprises:

a pair of elongated channels configured to position opposing pieces of lumber against the concrete pile, each of said channels having a first end and a second end;

a pair of base plates interposed orthogonally between a bottom surface of each of the channels, and a top surface of the second form receiver, said base plates being configured to form a horizontal platform around the pile; and a pair of bindings configured to removably secure the first ends of each of the channels together and the second ends of each of the channels together, respectively about the pile.

7. The system of claim 1, wherein each of the form units include:

a pair of angled form plates, each having a first side end, a second side end, and an approximately 90 degree bend along a center portion thereof;

a plurality of receptacles secured to each of the first and second ends of each of the angled form plates, said plurality of receptacles being configured to align to form pathways for receiving one or more connection rods;

wherein the pair of form plates are configured to be secured together via the receptacles and connection rods to form a hollow boxlike shape.

8. The system of claim 7, wherein each of the form units further include:

a sleeve positioned along the entirety of an outside periphery of the top end, said sleeve being configured to receive a bottom end of another form unit and to stack a plurality of form units in a vertical manner.

9. The system of claim 7, wherein each of the connection rods include a first end having a threaded edge, and a second end having a threaded recess, wherein the threaded end of a first connection rod is configured to be removably secured to the threaded recess of a second connection rod.

10. The system of claim 7, wherein said form plates are constructed from at least one of cast aluminum and rolled steel.

11. The system of claim 7, wherein said form plates are constructed from at least one of fiberglass and a composite material.

12. The system of claim 7, further comprising:

a plurality of standoff bolts disposed within the form plates and protruding into the hollow interior space, each of said standoff bolts being configured to adjust a location of the form plate with respect to the concrete pile.

13. The system of claim 7, further comprising:

a pair of form extenders configured to expand an overall dimension of at least one of the form units, each of said form extenders including an angled plate having a first side end with a plurality of receptacles that are configured to mate with the receptacles on the first side ends of the pair of angled form plates, and a second side end with a plurality of receptacles that are configured to mate with the receptacles on the second side ends of the pair of angled form plates.

14. A method for repairing a concrete pile having a damaged section utilizing a pile encapsulation system, said method comprising:

positioning a lower collar onto a damaged concrete pile, said lower collar including an upper surface having a first form receiver secured thereon, a pair of elongated channels configured to position opposing pieces of lumber against the concrete pile, each of said channels having a first end and a second end, a pair of base plates interposed orthogonally between a top surface of the channels, and a bottom surface of a first form receiver, said base plates being configured to form a horizontal platform around the pile, and a pair of bindings configured to removably secure the first ends of each of the channels together and the second ends of each of the channels together, respectively about the pile;

lowering the lower collar along the concrete pile to a location beneath the damaged section;

tightening the lower collar to the concrete pile via a binder;

positioning a form unit having a hollow interior space about the damaged section of the concrete pile;

securing a bottom end of the form unit onto a first form receiver of the lower collar;

positioning an upper collar onto the damaged concrete pile;

lowering the upper collar along the concrete pile;

securing a bottom end of a second form receiver of the upper collar onto a top end of the form unit;

tightening the upper collar to the concrete pile via a binder; and receiving concrete into the hollow interior space of the form unit via an inlet port.

* * * * *